United States Patent [19]

Mazzorana

[11] 4,260,903

[45] Apr. 7, 1981

[54] LOCKING DEVICES FOR ELECTRIC STARTER ACTUATORS

[75] Inventor: Alfred B. Mazzorana, Venissieux, France

[73] Assignee: Societe de Paris et du Rohne, Lyons, France

[21] Appl. No.: 957,969

[22] Filed: Nov. 6, 1978

[30] Foreign Application Priority Data

Nov. 18, 1977 [FR] France ..... 77 35294

[51] Int. Cl.[3] ..... F02N 15/06

[52] U.S. Cl. ..... 290/48

[58] Field of Search ..... 290/38, 48

[56] References Cited

U.S. PATENT DOCUMENTS

| | | | |
|---|---|---|---|
| 3,210,554 | 10/1965 | Seilly et al. | 290/38 |
| 3,358,667 | 12/1967 | Grubb et al. | 290/38 |
| 3,399,576 | 9/1968 | Seilly et al. | 290/38 |
| 3,666,958 | 5/1972 | Ruhle et al. | 290/48 |

*Primary Examiner*—J. V. Truhe
*Assistant Examiner*—W. E. Duncanson, Jr.
*Attorney, Agent, or Firm*—Dowell and Dowell

[57] ABSTRACT

In an internal combustion engine, an electric motor comprising a system of locking employing balls disposed between at least on ramp and a cage, wherein the displacement of the cage which retains the balls is directly controlled by the member actuating the translation of the actuator. Means are provided so that, when the actuator is in rest position, the locking system comprising balls provides connection of this actuator and the shaft.

6 Claims, 6 Drawing Figures

Fig. 5
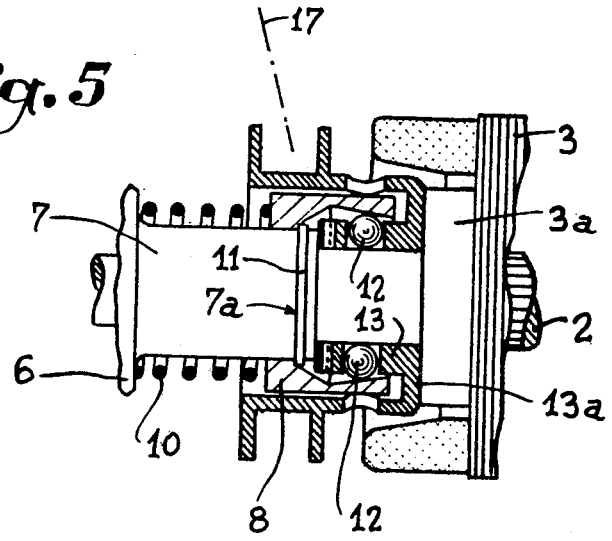
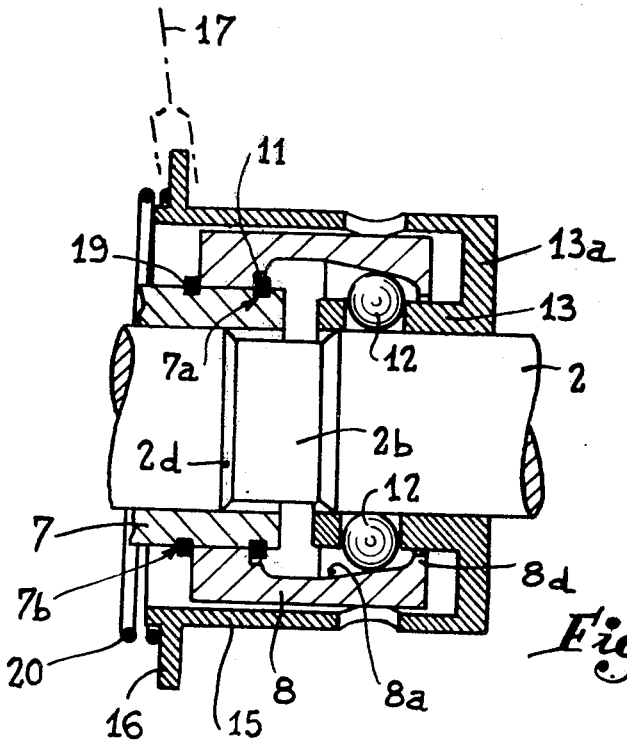
Fig. 6

LOCKING DEVICES FOR ELECTRIC STARTER ACTUATORS

The present invention relates to improvements in locking devices comprising balls, adapted to immobilise the actuator of an electric starter for an internal combustion engine with respect to its shaft.

The vibrations produced by the internal combustion engine of a vehicle as well as the jolting transmitted to the chassis by the wheels of this vehicle, are known to have an undesirable influence on the shaft of the electric starter mounted on said engine. The phenomena in question tend to bring about impingement of the actuator against the shaft which, in turn, vibrates to such an extent that, under certain conditions, it begins to reverberate and break.

The improvements forming the subject matter of the present invention aim at allowing the efficient connection of the actuator and the shaft of an electric starter so as to reduce to a large extent the risks of breakage mentioned hereinabove.

To this end, a locking system comprising balls is disposed between the actuator and the shaft, the cage of said system which retains the balls being directly connected to the member actuating the translation of the actuator so that this member when actuated initially displaces the cage which unwedges the balls so that the actuator can be displaced along the shaft.

According to the invention, the locking system may also be used as a stop for limiting the stroke of the actuator at its operation position.

The invention will be more readily understood on reading the following description with reference to the accompanying drawings, in which:

FIGS. 5 and 6 illustrate other variants according to the invention.

Figure 1:
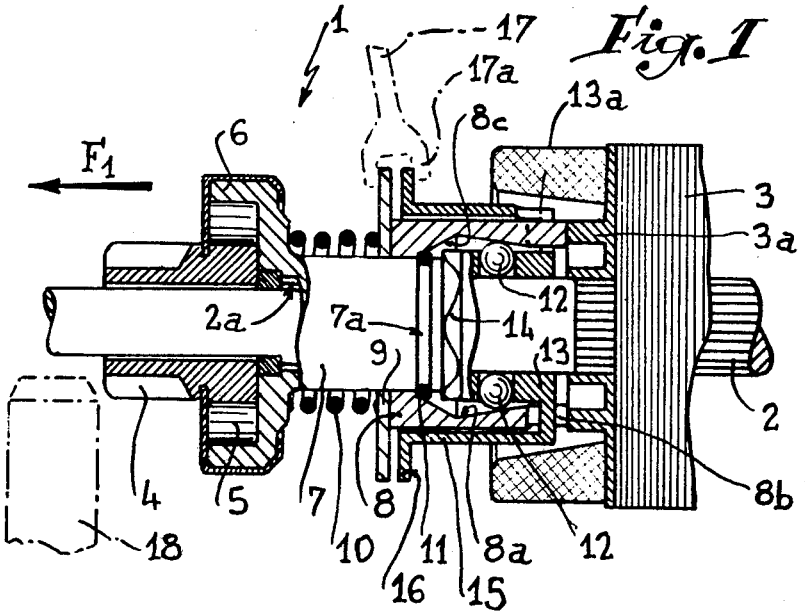
FIG. 1 is a partial longitudinal section through a starter comprising the improvements according to the invention.

Referring now to the drawings, FIG. 1 shows the actuator 1 of an electric starter for an internal combustion engine, mounted on the end of the shaft 2 bearing the armature 3 of the electric motor of the starter in question.

The actuator 1 conventionally comprises a pinion 4 connected by a free wheel device 5 to a cage 6 provided with a skirt 7 in which are made helical grooves cooperating with likewise helical channels 2*a* made in the shaft 2.

According to the invention, the skirt 7 penetrates in a tubular sleeve 8 comprising an inner bore 8*a* of truncated form, open in the direction of the pinion 4. The end of the sleeve facing the armature 3 comprises a series of teeth 8*b* abutting against the support 3*a* of the armature 3. A washer 9 is engaged about the skirt 7 and rests against the end of the sleeve 8 facing the cage 6. A compression spring 10 applies the washer 9 against the sleeve 8, by abutting against the cage 6. It will be noted that the part of the bore 8*a* of the sleeve 8, of largest diameter, extends by a truncated recessing 8*c*. A circlip 11 is placed in a groove 7*a* of the skirt 7 so that the recessing 8*c* abuts thereagainst under the effect of the reaction of the spring 10. Thus, the sleeve 8 is immobilised axially with respect to the actuator in the direction opposite that of its operating position (arrow F1).

Inside the sleeve 8 and around the shaft 2 is placed a row of balls 12 maintained in spaced apart relationship with respect to each other in known manner by means of a cage 13 whose end facing the skirt 7 is in abutment against an axially compressible resilient system 14, preferably made in the form of a corrugated washer. The cage 13 is connected by outwardly directed, radial arms 13*a* to a cylindrical sleeve 15 surrounding sleeve 8 and which comprises a flange 16 parallel to the washer 9.

Operation is as follows:

A rocking fork 17 controlled by an electromagnetic contactor is mounted to straddle the washer 9 and the flange 16. When the above-mentioned contactor is supplied with current, the fork rocks so that its right-hand arm 17*a* firstly causes the flange 16 and consequently the cage 13 to move towards the left (arrow F1), so that the flange 16 is applied against the washer 9 since the reaction of the spring 10 is sufficient to maintain said washer in place. The balls 12 which were in the rest position (FIG.1) wedged between the periphery of the shaft 2 and the truncated bore 8*a* of the sleeve 8 are therefore unwedged so that the sleeve and consequently the actuator are disconnected from the sahft.

The fork 17 then conventionally drives the whole of the actuator so that its pinion 4 meshes with the crown wheel 18 of the motor to be driven.

Figure 3:
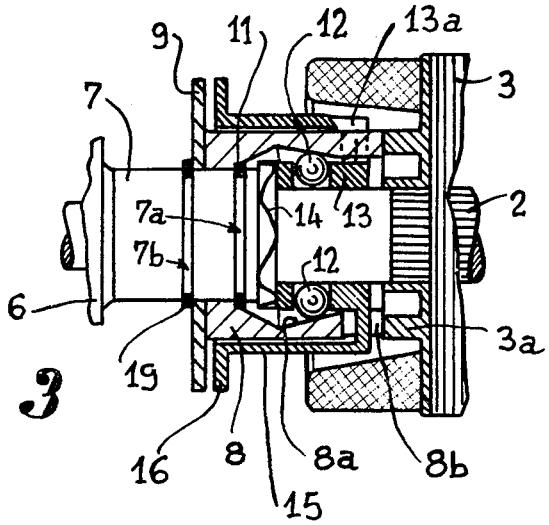
FIG. 3 is a first variant of the locking system according to the invention.

According to the variant of FIG. 3, the spring 10 has been eliminated, with the result that the sleeve 8 and the washer 9 are tightened against each other and in abutment against the circlip 11 by another circlip 19 disposed in a groove 7*b* of the skirt 7. The above-described functioning is applied to the variant in question since, there again, the flange 16 is displaced towards the left by the fork 17 against the reaction of the corrugated washer 14 to unwedge the balls 12.

Figure 4:
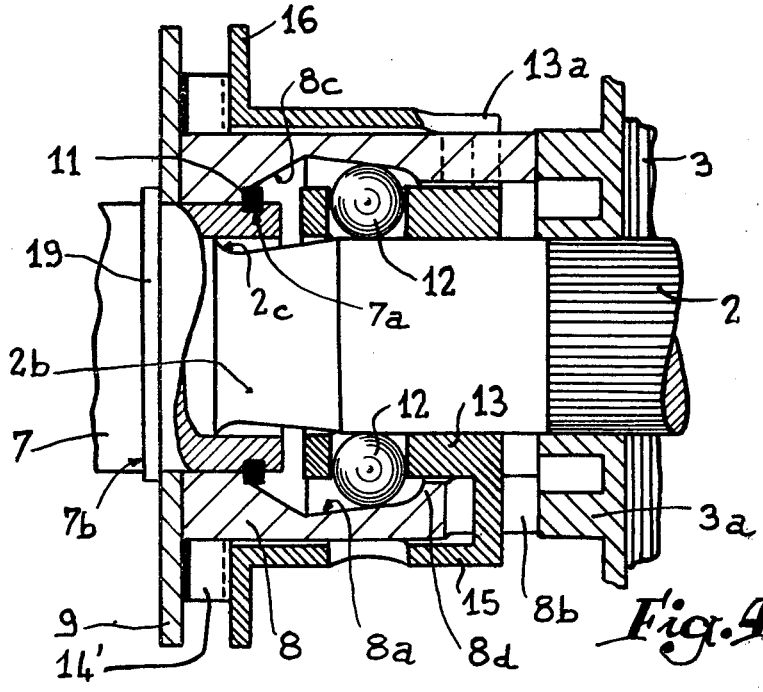
FIG. 4 is a partial view thereof on a larger scale.

As shown in FIG. 4, the truncated bore 8*a* terminates in a rounded bevel 8*d* determining a sort of annular nose. Furthermore, the shaft 2 comprises a bearing surface 2*b* provided to be truncated with conicity which is the reverse of that of the bore 8*a*, the join of the small base of this surface with the part of the shaft which follows it constituting a circular rounded shoulder 2*c*. Such an arrangement may also be applied to the variant of FIG. 3. The presence of the conical bearing surface 2*b* facilitates the disengagement of the balls 12 which, at the end of stoke of the actuator towards the operating position, are in abutment against the nose 8*d* and the shoulder 2*c* to positively determine the end position of the actuator.

It will be noted that in the variant of FIG. 4, the corrugated resilient washer 14 has changed place and it is then located at 14' between the flange 16 and the washer 9.

Figure 2:
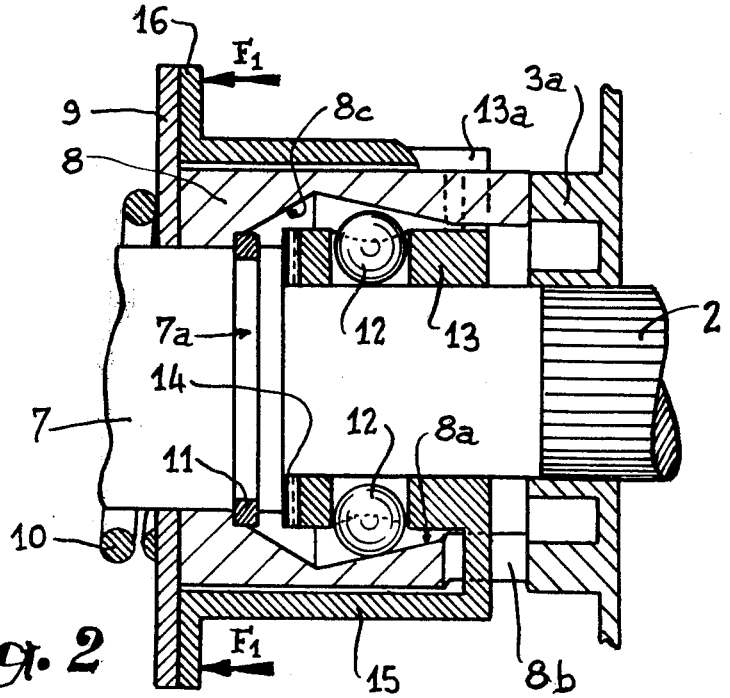
FIG. 2 is a partial view thereof on a larger scale.

The variant of FIG. 5 corresponds to the embodiment of FIGS. 1 and 2, but the washer 9 has been eliminated, the spring 10 being directly applied on the sleeve 8. It will also be noted that it is no longer said latter which abuts against the support 3*a* of the armature 3, but the radial arms 13*a* of the cage 13 directly.

In the variant of FIG. 6, the bore 8*a* of the sleeve 8 is identical to that of FIG. 4, i.e. it comprises the nose 8*d*. The bearing surface 2*b* of the shaft 2 is no longer conical, but cylindrical, the shoulder 2*d* on which the balls abut no longer being rounded, but conical. In this Figure, the spring 10 has been displaced, and replaced by another, referenced 20, presenting a larger diameter of winding and is applied against the flange 16 of the ball cage 13. Of course, the sleeve is then made fast with the skirt 7 by circlips 11, 19, as in FIGS. 3 and 4.

In the case of FIG. 6, the channels of the shaft and the grooves of the actuator may be straight since it is the action of the fork 17 which determines the end position of the actuator by imprisonment of the balls between the nose 8*d* of the sleeve 8 and the shoulder 2*d* of the shaft. On the contrary, in the variant of FIG. 5, the channels and the grooves mentioned above must be helical if it is desired to obtain a limitation of the stoke of the actuator by wedging of the balls between the sleeve and the shaft.

What is claimed is:

1. In a starter for an internal combustion engine, the starter having an armature supported on a shaft, and the starter having an actuator assembly slidable on the shaft and including a pinion, and the starter having lever means operable to slide the actuator assembly on the shaft through a stroke from a rest position to an engaged position wherein the pinion meshes with the flywheel of the engine, a locking system for locking the actuator assembly to the shaft when in the rest position, comprising:

(a) a cage slidable on the shaft adjacent to the actuator assembly and containing multiple balls disposed about the shaft, the cage carrying a flange engaged by the lever means and operable to slide the cage along the shaft toward the actuator means so that the cage moves the actuator means toward said engaged position;

(b) a sleeve carried by the actuator assembly and extending toward and surrounding the cage to retain the balls therein, the inner surface of the sleeve being concial and shaped to wedge the balls in locking engagement against the shaft when the cage is urged to slide on the shaft away from the actuator assembly, thereby locking the actuator assembly through the sleeve to the shaft;

(c) resilient means operative to urge the cage to slide on the shaft away from the actuator assembly when the lever means is in a rest position; and (d) and means for limiting the stroke of said actuator assembly to stop it in said engaged position.

2. The locking system as claimed in claim 1, wherein said actuator assembly has a shoulder, and said resilient means comprises a spring compressed between said soulder and said cage.

3. The locking system as claimed in claim 1, wherein said actuator means carries a washer fixed therearound, and said resilient means comprises a spring compressed between said washer and said cage.

4. The locking system as claimed in claim 1, wherein said resilient means comprises a corrugated washer.

5. The locking system as claimed in claim 1, wherein said means for limiting the stroke of the actuator assembly comprises a shoulder extending around said shaft and so located on the shaft as to engage and limit the movement of the balls, cage and actuator assembly when sliding on the shaft toward said engaged position.

6. The locking system as claimed in claim 1, wherein said means for limiting the stroke of the actuator assembly comprises a shoulder extending around said shaft, and an annular nose portion on the inner surface of the sleeve, said shoulder and nose portion being mutually located to confine the balls therebetween when the actuator assembly slides on the shaft to said engaged position.

* * * * *